US006895692B2

(12) United States Patent
Kramer

(10) Patent No.: US 6,895,692 B2
(45) Date of Patent: May 24, 2005

(54) DEVICE FOR HEAT TREATING METALLIC WEBS IN-LINE

(76) Inventor: Carl Kramer, Am Chorusberg 8, Aachen (DE), 52076

( * ) Notice: Subject to any disclaimer, the term of this patent is extended or adjusted under 35 U.S.C. 154(b) by 2 days.

(21) Appl. No.: 10/764,672

(22) Filed: Jan. 26, 2004

(65) Prior Publication Data

US 2004/0154182 A1 Aug. 12, 2004

(30) Foreign Application Priority Data

Jan. 28, 2003 (DE) ..... 103 03 228

(51) Int. Cl.[7] ..... F26B 13/00
(52) U.S. Cl. ..... 34/621; 34/629; 34/638
(58) Field of Search ..... 34/362, 363, 366, 34/618, 620, 621, 629, 639; 226/97.3, 7

(56) References Cited

U.S. PATENT DOCUMENTS

| | | | | |
|---|---|---|---|---|
| 3,590,495 A | * | 7/1971 | Tyson et al. | 34/654 |
| 3,834,040 A | * | 9/1974 | Russell et al. | 34/655 |
| 5,070,627 A | * | 12/1991 | Zagar | 34/641 |
| 5,172,844 A | * | 12/1992 | Mueller | 226/7 |
| 6,049,995 A | * | 4/2000 | Rogne et al. | 34/269 |
| 6,088,930 A | * | 7/2000 | Robin et al. | 34/267 |

FOREIGN PATENT DOCUMENTS

| | | |
|---|---|---|
| EP | 0 864 519 A1 | 9/1998 |
| JP | 55047326 | 4/1980 |
| JP | 57039133 | 3/1982 |
| JP | 58045334 | 3/1983 |
| JP | 58048641 | 3/1983 |
| JP | 58048641 A | 3/1983 |
| JP | 58193351 | 11/1983 |
| JP | 63277165 | 11/1988 |
| JP | 02061011 | 3/1990 |
| JP | 07090618 | 4/1995 |

OTHER PUBLICATIONS

International Search Report dated Mar. 4, 2004 related to EP 03 02 9982.

International Search Report dated May 28, 2004 related to EP 03 02 9982.

* cited by examiner

*Primary Examiner*—Stephen Gravini
(74) *Attorney, Agent, or Firm*—RatnerPrestia

(57) ABSTRACT

A device for heat treating metallic webs in-line, in particular for operation with a low-density protective gas, comprises stabilising nozzle systems which stabilise the course of the web and effect heat transfer, primarily by forced convection, in the heating portion and at least in the first portion of cooling. The web is guided in a non-contact process in the treatment portion localized by rollers. The course of the web exhibits a concave curvature (as viewed from above), at least in a partial area in the treatment portion. The area of said concave curvature can be in a fluid which is different from the fluid with which the web is blown in the heating portion and at least in the first portion of the cooling area.

20 Claims, 4 Drawing Sheets

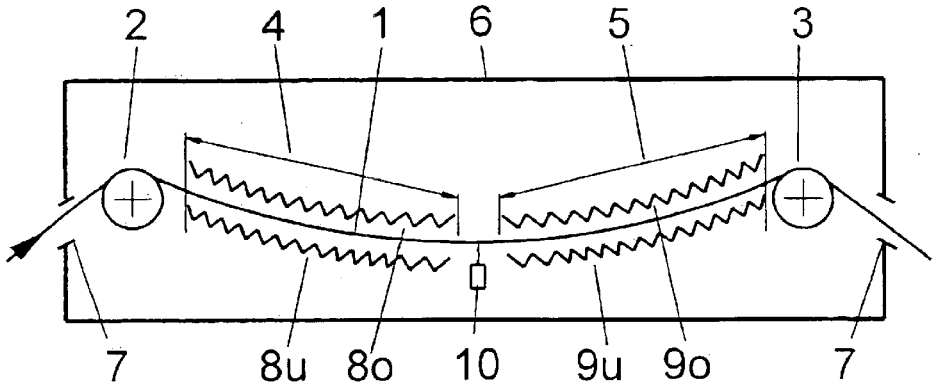
Figur 1
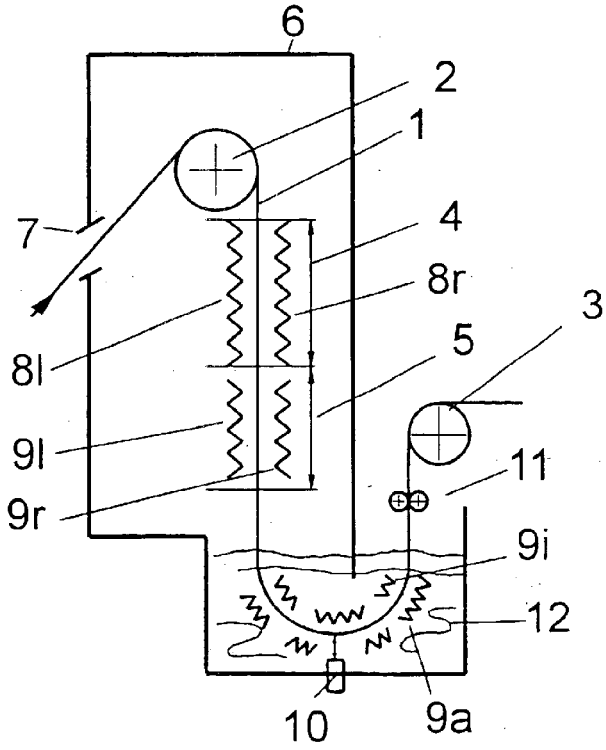
Figur 2

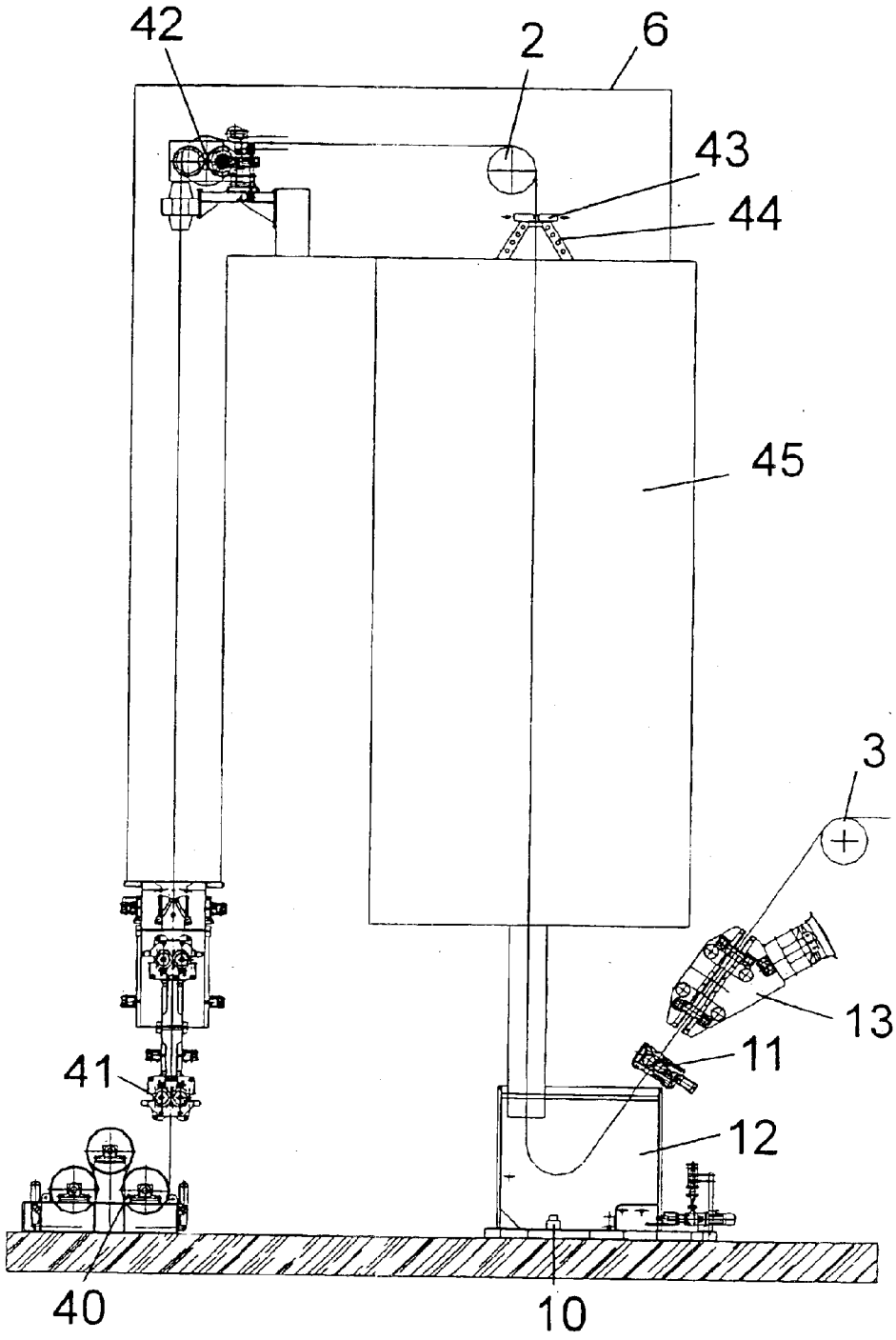
Figur 3

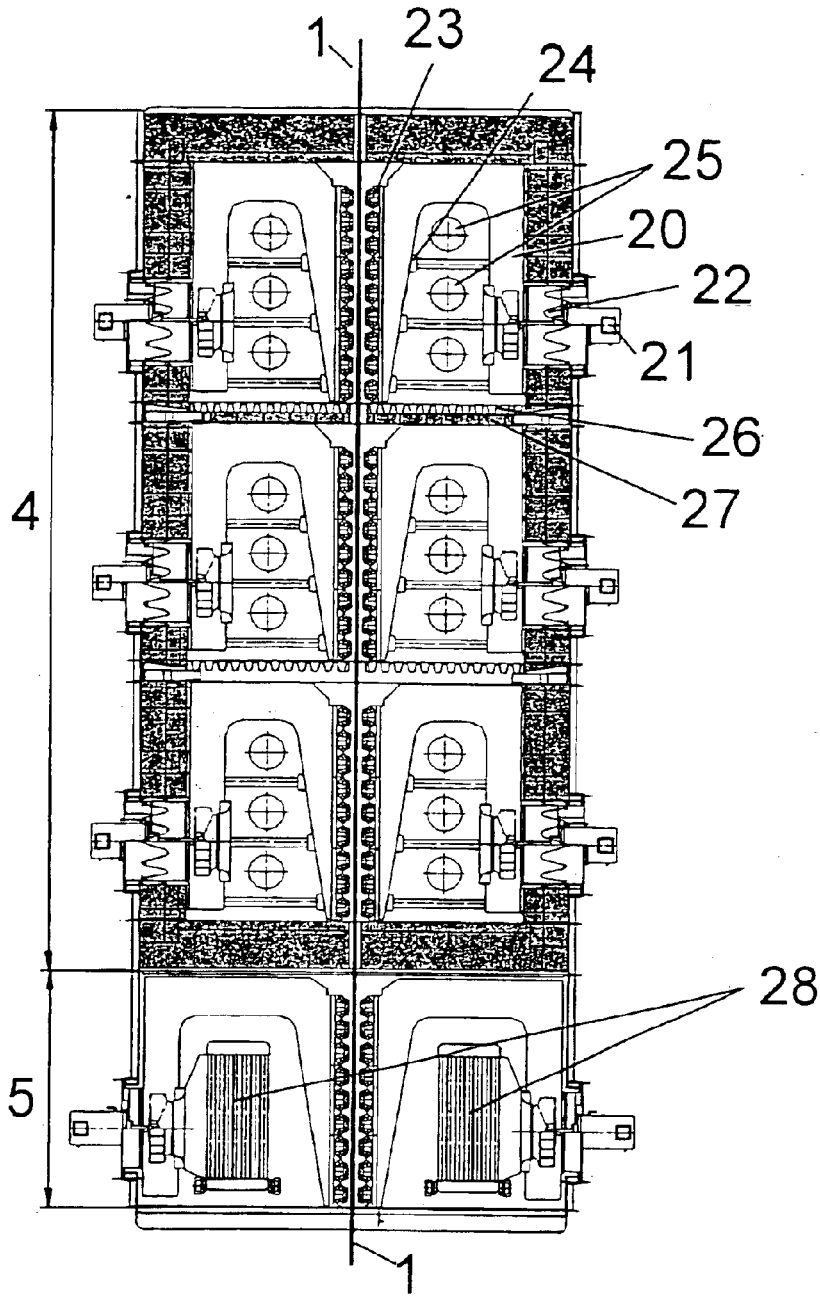
Figur 4

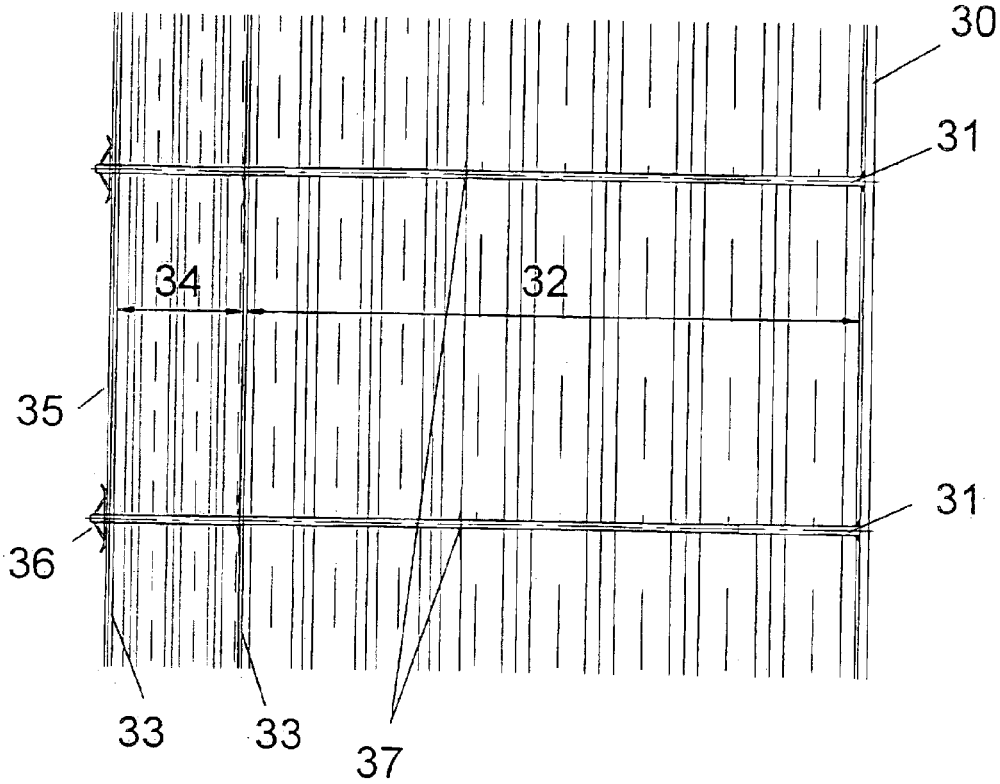
Figur 5

DEVICE FOR HEAT TREATING METALLIC WEBS IN-LINE

The invention relates to a device for heat treating metallic webs in-line, i.e. said webs pass the treatment device continuously, in particular for operation with a low-density protective gas, such as for example a nitrogen-hydrogen mixture with a high proportion of hydrogen.

In-line plants are very important in heat treating webs of both ferrous and non-ferrous metal alloys, such as for example copper alloys. In the case of webs whose surface can oxidise during heat treatment, in-line heat treatment is usually performed using a protective gas. This protective gas can consist mainly of nitrogen. For some heat treatment processes, however, it is useful to use a protective gas with a high proportion of hydrogen, or even pure hydrogen.

Using pure hydrogen as the protective gas affords the advantage of better heat transfer, such that for the same length of the plant, a substantially higher throughput can be achieved than with nitrogen.

Since high demands are generally made on the quality of the surface of webs of both ferrous alloys and non-ferrous metal alloys, the modern prior art is to guide said webs in a non-contact process. This is achieved by hanging the web vertically in a tower furnace, or in a horizontal furnace by assuming a catenary which is set by the effect of gravity.

A particular disadvantage of the catenary is that, for larger web lengths in the heat treatment portion, both high web sagging and high web tension occur. This greatly limits the throughput of such plants.

In order to avoid these disadvantages, plants with horizontally guided webs have been developed in which the web is stabilised and supported in its horizontal position in the treatment portion by means of suspension nozzles. A precondition of such plants, however, is that a sufficiently high load capacity can be achieved, which at high temperatures, with low-density protective gas such as for example a nitrogen-hydrogen mixture with a high proportion of hydrogen, and heavy webs causes major problems. Therefore, when a decision has been made to advantageously use a protective gas with a high proportion of hydrogen, one is often forced to use the aforementioned tower furnaces plants or plants which guide the web in accordance with a catenary.

It is an object of the invention to provide a device which combines the advantages of guiding the web by means of stabilising suspension nozzles with the advantages of tower furnaces plants and plants which guide the web in accordance with a catenary, without having to accept the disadvantages of the known plant.

This is achieved by a combination of the features listed in the characterising portion of the main claim.

Expedient embodiments are defined by the sub-claims.

In the following, the invention is explained in more detail by way of example embodiments and by referring to the enclosed, schematic drawings.

There is shown:

FIG. 1 an embodiment of the device in which the rollers which localise the treatment area of the web are situated at the same height;

FIG. 2 an embodiment of the device with a vertical run of the web, which is followed by the area with a concave run of the web (as viewed from above);

FIG. 3 a schematic representation of the device with a vertical run of the web, and of further details on how the web is guided;

FIG. 4 a cutaway of the treatment portion for a device in which the web is guided vertically, in which further details of the embodiment may be seen; and FIG. 5 the schematic of an advantageous embodiment of the outer wall.

In the embodiment of the device in accordance with FIG. 1, comprising rollers 2, 3 at the same height, a web 1 is guided, sagging, in the treatment area. This sagging occurs due to its inherent weight, i.e. due to the effect of gravity. The rollers 2, 3 and the treatment area are arranged in a casing 6 shown schematically in FIG. 1. This casing comprises sealed conduits 7 for inputting and outputting the web, which are likewise indicated only schematically in FIG. 1.

Nozzle systems 8*u* and 8*o* for the heating portion 4 and 9*u* and 9*o* for the cooling portion 5, shown schematically, are provided above and below the web 1. With the aid of these blowing systems, which are embodied as suspension nozzles which support and simultaneously positionally stabilise the web, preferably as known from EP 0 864 518 B1, the web 1 is held in a particular position, such that the web tension required can be reduced due to the supporting effect of the nozzle systems 8 and 9. The device is therefore also capable of guiding comparatively heavy metal webs of high-density metal with relatively little sagging, since a portion of the weight is supported by the stabilising suspension nozzle system. These nozzle systems can also simultaneously exert a particularly pronounced laterally stabilising effect on the web in the area of greatest concave curvature. In the case of thin webs, the web can be guided in the same form using the same system with no appreciable tensile forces, since in this position the web finds a stable position, such as between gas springs, due to the stabilising suspension nozzle systems.

A sensor 10 serves to monitor the position of the web and is arranged in the vicinity of the trough of the course of the web. Said sensor can for example be a sensor 10 which operates using microwaves in accordance with the principle of radar. It is advantageous to arrange a number of sensors over the width of the web, since the width of the web can be varied during operation for one and the same device. In this way, a number of sensors are available with wide webs 1, while at least one sensor 10 always reliably detects the position of the web in the case of the narrowest web 1.

FIG. 2 shows an embodiment of the device with a vertical run of the web downstream of the roller 2. As in the device shown schematically in FIG. 1, the entire treatment area including the roller 2 is also surrounded by a protective gas-tight casing 6 in this device. The web enters through said casing 6 through the schematically shown sealing means 7. In accordance with the prior art, this means is for example embodied as a roller seal, and need not be explained further.

In the descending run of the web, the web 1 passes first through the heating portion 4 and then through the first area of the cooling portion 5. The stabilising blowing nozzle systems 8*l*, 8*r* for the heating portion and 9*l*, 9*r* for the cooling portion are situated on both sides of the web 1.

At the lower end, the web's course has a concave curvature (as viewed from above). This course is situated in a fluid 12, e.g. water. This fluid 12, generally a suitable liquid, simultaneously demarcates the inner space of the encasing 6 against the outer atmosphere and thus separates the protective gas from the ambient air.

In the fluid basin, nozzle systems 9*i*, 9*a* are situated on both the inner curvature and the outer curvature and act in a similar way to the systems 8 and 9 which operate in the gas atmosphere, but are specially adapted to and designed for operating with confirming fluid, and direct the fluid, in particular water, onto the web 1. The jets of these fluid nozzles 9*i*, 9*a* exert stabilising forces onto the web which also guide thin webs 1, which would otherwise deviate, in the desired concave form. In a particularly advantageous embodiment, these nozzle systems also have a positionally stabilising effect in the direction perpendicular to the run of the web, similar to a web centring control. It is, however, also possible to arrange such stabilising nozzles only in the area of the vertical legs of the run of the web, which localise the area which is curved concave, such that the run of the web in between can be freely set and only the position in the lowest area is monitored by the sensor 10.

The position of the run of the web is detected and controlled at the trough of the concave curvature by means of at least one sensor 10, such that the desired form is maintained in all operational conditions. In a liquid as the confirming fluid, the altitude of the web is advantageously detected in accordance with the principle of echo-location.

FIG. 3 shows further details of a typical run of the web of the device in accordance with the invention. The device is sealed with respect to the outer atmosphere at the web input using a twin-roller seal 41. The combination of rollers 40 serves to reduce web traction from the higher traction before the combination of rollers 40 to the lower traction in the heat treatment portion. A control roller 42 is arranged at the first turn of the run of the web. A sensor is situated before this control roller 42, for detecting the position of the web, and a further pressing roller having a smaller diameter is situated downstream of the control roller 42 and ensures that the web 1 contacts the turning roller 42 even when the web traction is low.

Below the second turning roller 2, which localises the treatment area of the web, there is situated a shutter means 43 which consists of two shutters which move perpendicular to the web. The web input opening, which is formed by the input collar 44—which is advantageously water-cooled and provided with thermal insulation—and opens into the heating portion 4 which can also be operated at a significant temperature of for example approx. 950° C., is shut with the aid of said shutter means 43, such that no heat can emerge upwards from the heat treatment portion 4 while the web is stalled, where it may result in damage to the turning roller 42 and/or its coating.

Another cooling device (not shown) can be provided between the turning roller 42 and the entrance 7 of the web into the heat treatment portion 4, said cooling device ruling out unacceptably high roller temperatures. Such a cooling means can for example operate by blowing the web with low-temperature protective gas. It can also be advantageous to arrange the combination of rollers 40, for reducing the web traction to the lower value in the treatment portion, directly before the entrance of the web into the same, such that the roller 2 is unnecessary.

The heat treatment portion 4 and the first area of the cooling portion situated below it are indicated in FIG. 3 by the reference numeral 45. The web 1 is guided out of the cooling portion 5 through a protective gas-tight channel which dips into the liquid shutter 12. The web running towards the roller 3 is guided by squeezing rollers 11 and the fluid 12 still adhering to the web after this, generally water, is dried by the convection dryer 13 which can be heated.

FIG. 4 shows, as an example, more details of the embodiment with a vertical run of the web. The figure shows three heating zones 4 arranged one above the other and a cooling zone 5 attached below said heating zones 4. In the longitudinal section shown in FIG. 4, the flow guides of the three heating zones 4 and the cooling zone 5 situated below them have the form of a U perpendicular to the run of the web. In the example of FIG. 4, the legs of the U point downwards. The opposite arrangement, i.e. U-legs pointing upwards, is however also possible.

The stabilising nozzle fields 23 are arranged on the outer side of the leg of the U facing the web 1. In the space enclosed by the legs of the U, jet heating pipes 25 are situated in the heating zones 4 and coolers 28, in particular heat exchangers, are situated in the cooling zone 5. Radial fans 21 serve to drive the flow and are inserted into the outer wall by means of bucklers filled with insulation material. The flow casings 20 are connected via crown-like structures 22 to the supporting structure of the fan 21 and thereby in turn to the supporting structure of the outer casing 6. Force is transferred at the tips of the crown teeth.

Embodying this attachment in the form of crowns ensures that no dents, fractures or similar difficulties can occur due to thermal tension and thermal expansion.

The zones are demarcated from each other in the heating portion by means of trapezium sheet metal bases 26. In the case of the first base 26, another layer of insulation material 27 is situated below said trapezium sheet metal, such that a temperature difference can be set and maintained between the first zone and the second zone. This embodiment of the intermediate base 26 in conjunction with thermal insulation 27 is of course possible between all the zones.

The wall design shown in FIG. 5 is particularly advantageous in devices for operating at high temperatures, e.g. above 800° C. in the heating portion, using protective gas with a high proportion of hydrogen. The outer skin consists of a steel sheet metal casing 30 welded gas-tight. Holding pins 31 for layers 32 of thermal insulation material are attached, e.g. welded, to its inner wall. These layers 32 applied to the outer wall 30 consist of fibres with a high proportion of $SiO_2$, which exhibit good mechanical properties but tend to degrade at high temperatures of approximately 800° C. and in a hydrogen atmosphere, as the $SiO_2$ is reduced to SiO. In order to avoid intensive contact with the hydrogen atmosphere, but in particular in order to reduce the penetration of hot hydrogen gas into said layers, a film 33 made of highly refractory material, e.g. a nickel-chromium alloy, is layered onto said layer 32. Further layers 34 made of $Al_2O_3$ fibres—which are mechanically less stable but more resistant against hydrogen, even at high temperatures and significantly more expensive—are then layered onto this layer 33.

A further film 33 made of highly refractory material serves to cover the wall, onto which relatively small-format sheet metal elements 35, preferably made of perforated sheet metal, are layered as mechanical protection. All the layers are held by platelets 36 which are slid onto the pins 31. In order to be able to easily exchange the outer fibre layers, it is expedient to also apply such platelets, preferably produced from thin sheet metal, to the first film layer, as an intermediate attachment.

As may be gathered from the above description, the web 1 is blown with impact jets of heating and/or cooling fluid, in particular a gas, e.g. pure hydrogen or a hydrogen-nitrogen mixture with a high proportion of hydrogen, which exert a planar force on the web 1 which, similar to a spring, increases with decreasing distance between the web 1 and the nozzle field; this results in a positionally stabilising effect on the web, the magnitude of said stabilising force depending on the dynamic pressure of the blowing fluid at the nozzle output of the impact jets.

The distance between the nozzle fields, arranged on both sides of the web 1 in the heat treatment portion, is substantially constant in each of the two areas, i.e. heating 4 and cooling 5, meaning that the change in distance is ±10% at most.

A suitable nozzle system for achieving the desired effect is described in EP 0 864 518 B1 and has nozzle panes which are consecutive in the direction of the run of the web and comprise nozzle openings made of round holes and/or slit nozzles, wherein the width of the nozzle panes—measured parallel to the direction of the run of the web—changes over the width of the nozzle field—measured perpendicular to the direction of the run of the web. The nozzle panes are at least partially bordered at their circumference by slit nozzles.

This stabilising nozzle system can be embodied and operated such that the web 1 is also stabilised perpendicular to the run of the web by the nozzle system, said laterally stabilising effect being particularly pronounced in the area of the run of the web having a concave curvature (as viewed from above).

Any suitable fluid can be used as the confining fluid for the area 12, wherein a liquid is preferably used. A suitable liquid can be selected by taking into account its chemical compatibility with the material of the metallic webs.

Using this device, both ferrous and/or steel webs and webs of non-ferrous metals can be treated.

What is claimed is:

1. A device for heat treating metallic webs in-line, in a gas atmosphere, in particular for operation with a low-density protective gas, characterized by the combination of the following features:

a) all of the heating and at least the first portion of the cooling is performed in the heat treatment portion, primarily by means of forced convection by blowing said web with impact jets of a heating and/or cooling fluid;

b) during said heating and at least in the first portion of said cooling, the web is guided in a non-contact process;

c) nozzle fields for generating said impact jets exert a positionally stabilising effect on the web by deploying a planar force onto the web which, similar to a spring, increases with decreasing distance between the web and the nozzle field, the magnitude of said stabilising force depending on the dynamic pressure of the blowing fluid at the nozzle output of the impact jets;

d) the distance between the nozzle fields, arranged on both sides of the web in the heat treatment portion, is substantially constant in each of the respective areas, i.e. heating and cooling;

e) the web is tensed, due to the effect of gravity, in the treatment area localised by rollers;

f) the course of the web between said rollers, which localise the treatment area, exhibits a concave curvature (as viewed from above), at least in a partial area; and g) the position of the web is controlled in the area of the trough of the concave curvature (as viewed in the longitudinal section) by at least one sensor which operates in a non-contact manner.

2. The device as set forth in claim 1, characterised in that the rollers which localise the treatment area are at the same height.

3. The device as set forth in claim 1, characterised in that the rollers which localise the treatment area are situated at different heights.

4. The device as set forth in claim 3, characterised in that the rollers are arranged vertically one above the other.

5. The device as set forth in claim 1, characterised in that the web is also stabilised perpendicular to the run of the web by the nozzle system for blowing impact jets, said laterally stabilising effect being particularly pronounced in the area of the run of the web having a concave curvature (as viewed from above).

6. The device as set forth in claim 5, characterised in that the course of the web having a concave curvature (as viewed from above) in the treatment area is in a fluid which is different from the blowing fluid in the heating portion and in the first portion of the cooling area and which simultaneously demarcates the space, which localises the device, with respect to the ambient atmosphere.

7. The device as set forth in claim 6, characterised in that, in the fluid which serves to demarcate the inner space of the device with respect to the outer atmosphere, nozzles which stabilise the position of the web are arranged above and below the web and operated using the fluid which serves to demarcate from the outer atmosphere.

8. The device as set forth in claim 7, characterised in that a suitable liquid, including water, is used as said fluid.

9. The device as set forth in claim 7, characterised in that the sensor for detecting the position of the web operates in accordance with the principle of echo-location.

10. The device as set forth in claim 9, characterised in that the rollers which demarcate the treatment area at the web output are squeezing rollers.

11. The device set forth in claim 10, characterised in that, downstream of the turning roller (as viewed in the direction of the run of the web) which demarcates the web treatment area at the web input, the web runs vertically and the lower end of the vertical course of the web is followed by a concave web curvature (as viewed from above) which is situated in the fluid shutter which demarcates the treatment space.

12. The device as set forth in claim 11, characterised in that said fluid shutter comprises a suitable liquid, including water.

13. The device as set forth in claim 12, characterised in that the web is blown, for the purpose of convectional heat transfer, by means of flow systems which in the longitudinal section (viewed perpendicular to the plane of the web):

a) have the form of a U comprising legs parallel to the run of the web;

b) wherein the leg of the U facing the web is fitted with the stabilising nozzle system and c) a radial fan is built into the leg of the U facing away from the web; and d) the flow guide casing is attached to the outer wall with the aid of a crown-shaped component; wherein e) the force is transferred from the tips of the teeth of the crown onto the outer casing and the supporting structure connected to the outer casing.

14. The device as set forth in claim 13, characterised in that, between the legs of the U-shaped flow guide, jet heating pipes are installed in the heating portion for heating the device, and coolers, in particular heat exchangers, for cooling the blowing fluid are situated at this location in the cooling portion.

15. The device as set forth in claim 14, characterised in that the individual zones of the device are demarcated from each other by intermediate bases made of sheet metal which are formed as trapezium metal sheets.

16. The device as set forth in claim 15, characterised in that said intermediate bases made of trapezium sheet metal for reducing the temperature equalisation between adjacent zones is provided on at least one side with layers made of thermal insulation material.

17. The device as set forth in claim 16, characterised in that the stabilising nozzle system consists of nozzle panes which are consecutive in the direction of the run of the web and comprise nozzle openings made of round holes and/or slit nozzles, whose width—measured parallel to the direction of the run of the web—changes over the width of the nozzle field—measured perpendicular to the direction of the run of the web, and in that the nozzle panes are at least partially bordered at their circumference by slit nozzles.

18. The device as set forth in claim 16, characterised in that the gas-tight outer skin on its inner side comprise a wall design which from the outside in is composed as follows:

a) outer layers made primarily of fibres containing silicon dioxide $SiO_2$;

b) a foil made of a refractory material;

c) layers of fibre mat made of aluminum oxide $Al_2O_3$;

d) a film made of a highly refractory material;

e) a perforated sheet metal cover consisting of a small-format, partially overlapping perforated metal sheets;

wherein the individual layers of said wall design are held by spearing them onto pins attached to the inner wall of the gas-tight outer skin, and corresponding attachment platelets are slid onto said pins once the design described above has been put in place.

19. The device as set forth in claim 1, wherein said low-density protective gas is a nitrogen hydrogen mixture with a high proportion of hydrogen.

20. The device of claim 18, wherein said foil and said film each comprises a nickel-chromium alloy.

* * * * *